US008820400B2

(12) United States Patent
McGuire

(10) Patent No.: US 8,820,400 B2
(45) **Date of Patent: *Sep. 2, 2014**

(54) EROSION RESISTANT FRAC HEAD

(75) Inventor: Bob McGuire, Meridian, OK (US)

(73) Assignee: Oil States Energy Services, L.L.C., Houston, TX (US)

( * ) Notice: Subject to any disclaimer, the term of this patent is extended or adjusted under 35 U.S.C. 154(b) by 344 days.

This patent is subject to a terminal disclaimer.

(21) Appl. No.: 13/227,943

(22) Filed: Sep. 8, 2011

(65) Prior Publication Data

US 2011/0315370 A1 Dec. 29, 2011

Related U.S. Application Data

(60) Continuation-in-part of application No. 12/874,730, filed on Sep. 2, 2010, now Pat. No. 8,016,031, which is a division of application No. 12/052,369, filed on Mar. 20, 2008, now Pat. No. 7,789,133.

(51) Int. Cl.
*E21B 33/13* (2006.01)

(52) U.S. Cl.
USPC ..... 166/90.1; 166/177.5

(58) Field of Classification Search
CPC ..... E21B 33/068; E21B 43/26
USPC ..... 166/90.1, 75.15, 177.5, 902
See application file for complete search history.

(56) References Cited

U.S. PATENT DOCUMENTS

| | | | | |
|---|---|---|---|---|
| 2,660,248 | A | 11/1953 | Brown | |
| 4,169,504 | A * | 10/1979 | Scott | 166/90.1 |
| 4,284,475 | A | 8/1981 | Anthony | |
| 4,832,128 | A | 5/1989 | Light et al. | |
| 4,915,177 | A | 4/1990 | Claycomb | |
| 5,012,865 | A | 5/1991 | McLeod | |
| 5,275,441 | A | 1/1994 | Claycomb | |
| 5,540,282 | A | 7/1996 | Dallas | |
| 5,636,691 | A | 6/1997 | Hendrickson et al. | |
| 5,785,121 | A | 7/1998 | Dallas | |
| 5,787,985 | A | 8/1998 | Oneal et al. | |
| 5,819,851 | A | 10/1998 | Dallas | |
| 5,957,198 | A | 9/1999 | Haynes | |
| 6,019,175 | A | 2/2000 | Haynes | |
| 6,176,313 | B1 | 1/2001 | Coenen et al. | |
| 6,220,363 | B1 | 4/2001 | Dallas | |
| 6,289,993 | B1 | 9/2001 | Dallas | |
| 6,364,024 | B1 | 4/2002 | Dallas | |
| 6,447,021 | B1 | 9/2002 | Haynes | |
| 6,491,097 | B1 | 12/2002 | Oneal et al. | |

(Continued)

FOREIGN PATENT DOCUMENTS

| | | |
|---|---|---|
| CA | 2430784 | 11/2003 |

OTHER PUBLICATIONS

Merriam-Webster Dictionary definitions of "O-ring" and "pancake", accesses Dec. 28, 2010 at merriam-webster.com.

*Primary Examiner* — Blake Michener

(74) *Attorney, Agent, or Firm* — Nelson Mullins Riley & Scarborough, LLP

(57) ABSTRACT

An erosion resistant frac head with a convergence chamber, an expansion chamber and a mixing chamber provides improved resistance to erosion caused by abrasive frac fluids pumped through the frac head. A bottom leg of the erosion resistant frac head terminates in a flange and may be replaced in the field by field hands.

19 Claims, 7 Drawing Sheets

(56) References Cited

U.S. PATENT DOCUMENTS

| | | | | |
|---|---|---|---|---|
| 6,516,861 | B2 | 2/2003 | Allen | |
| 6,575,247 | B2 | 6/2003 | Tolman et al. | |
| 6,626,245 | B1 | 9/2003 | Dallas | |
| 6,712,147 | B2 | 3/2004 | Dallas | |
| 6,769,489 | B2 | 8/2004 | Dallas | |
| 6,817,421 | B2 | 11/2004 | Dallas | |
| 6,817,423 | B2 | 11/2004 | Dallas | |
| 6,834,717 | B2 | 12/2004 | Bland | |
| 6,899,172 | B2 | 5/2005 | McLeod et al. | |
| 6,918,439 | B2 | 7/2005 | Dallas | |
| 6,964,306 | B2 | 11/2005 | Bunney | |
| 7,032,677 | B2 | 4/2006 | McGuire et al. | |
| 7,066,269 | B2 | 6/2006 | Dallas et al. | |
| 7,125,055 | B2 | 10/2006 | Dallas | |
| 7,159,652 | B2 | 1/2007 | McGuire et al. | |
| 7,159,663 | B2 | 1/2007 | McGuire et al. | |
| 7,204,474 | B2 | 4/2007 | McGuire et al. | |
| 7,210,525 | B2 | 5/2007 | Dallas | |
| 7,213,641 | B2 | 5/2007 | McGuire et al. | |
| 7,278,490 | B2 | 10/2007 | McGuire et al. | |
| 7,296,631 | B2 | 11/2007 | McGuire | |
| 7,377,316 | B2 | 5/2008 | Boyd | |
| 7,478,673 | B2 | 1/2009 | Boyd | |
| 7,481,239 | B2 | 1/2009 | McGuire et al. | |
| 7,628,201 | B2 | 12/2009 | McGuire et al. | |
| 7,789,133 | B2 * | 9/2010 | McGuire | 166/90.1 |
| 7,828,053 | B2 | 11/2010 | McGuire et al. | |
| 8,016,031 | B2 * | 9/2011 | McGuire | 166/90.1 |
| 2003/0192688 | A1 | 10/2003 | Thomson et al. | |
| 2006/0090891 | A1 * | 5/2006 | McGuire et al. | 166/90.1 |
| 2007/0187087 | A1 | 8/2007 | McGuire et al. | |
| 2007/0199718 | A1 | 8/2007 | Boyd | |
| 2007/0251578 | A1 | 11/2007 | McGuire | |
| 2008/0257540 | A1 | 10/2008 | McGuire et al. | |
| 2013/0075079 | A1 * | 3/2013 | Artherholt | 166/177.5 |

* cited by examiner

EROSION RESISTANT FRAC HEAD

RELATED APPLICATIONS

This application is a continuation-in-part of U.S. patent application Ser. No. 12/874,730 filed Sep. 2, 2010, which was a division of U.S. patent application Ser. No. 12/052,369 filed Mar. 20, 2008, now U.S. Pat. No. 7,789,133.

FIELD OF THE INVENTION

This invention relates in general to hydrocarbon well stimulation equipment and, in particular, to an erosion resistant frac head.

BACKGROUND OF THE INVENTION

Current methods for completing or re-completing hydrocarbon wells may involve pumping very large volumes of propant into one or more production zones of the well. More than 10,000,000 pounds (4,555,000 kg) of propant (e.g., frac sand, sintered bauxite, or ceramic pellets) mixed with a fracturing fluid such as "slick water" may be pumped through a frac head and down a production casing into production zone(s) of the hydrocarbon well at rates of 300+ barrels/minute during a well stimulation procedure. As understood by those skilled in the art, pumping millions of pounds of abrasive propant through known frac heads at high rates causes erosion, commonly referred to as "wash", in those frac heads.

The construction and maintenance of frac heads requires skilled labor and expensive alloy steel (e.g. 4140 steel). In order to reduce the cost of maintaining frac heads, abrasion-resistant frac heads with hardened steel inserts were invented, as taught for example in applicant's U.S. Pat. No. 7,213,641 which issued May 8, 2007. Abrasion resistant frac heads significantly reduce frac head maintenance, but do not eliminate it. Because hardened steels are brittle, they cannot be used to line a bottom end of a central passage through the frac head, which is subject to impact and compression forces. Consequently, even abrasion-resistant frac heads require maintenance in addition to the replacement of the hardened steel inserts. To facilitate such maintenance, multipart frac heads with replaceable components were invented, as described in Assignee's co-pending published patent application 2008/0257540 filed Apr. 17, 2007 and published on Oct. 23, 2008, the entire specification of which is incorporated herein by reference.

FIG. 1 is a schematic cross-sectional diagram of one embodiment of Assignee's multipart frac head 100 described in the above-identified co-pending patent application. The multipart frac head 100 has a frac head body 102 and a plurality of entry ports, two of which (104*a*, 104*b*) are shown. Frac heads are generally equipped with 2-5 entry ports. In this embodiment side entry ports 104*a*, 104*b* are welded to the frac head body 102 using methods known in the art. Each side entry port 104*a*, 104*b* includes a respective central bore 106*a*, 106*b* in fluid communication with a mixing chamber 108 of the frac head body 102. A top end of each side entry port 104*a*, 104*b* supports a frac iron adapter 112*a*, 112*b* that is also known in the art.

The frac head body 102 has a top end 118 with a central passage 120 in fluid communication with the mixing chamber 108. In this embodiment, the top end 118 terminates in a threaded union described in Applicant's U.S. Pat. No. 7,125,055 entitled Metal Ring Gasket for a Threaded Union, which issued on Oct. 24, 2006, the specification of which is incorporated herein by reference in its entirety. The threaded union connector is compatible with a complementary threaded union connector 128 of equipment connected to the multipart frac head 100. The equipment is typically a high-pressure valve, but may be any other well completion, re-completion or workover equipment.

A bottom of the mixing chamber 108 has a funnel-shaped section that tapers inwardly to a central passage 132 of a bottom leg 134 secured to the frac head body 102. The tapered bottom end of the mixing chamber 108 is lined with a wear-resistant insert 146. A lock nut 150 secures the bottom leg 134 in the frac head body 102. A bottom end of the bottom leg 134 terminates in a threaded union connector 154 described in Applicant's above-referenced U.S. Pat. No. 7,125,055.

Although Assignee's multipart frac heads with replaceable components has significantly reduced maintenance costs, further improvements are desirable.

There therefore exists a need for a frac head that is more quickly and easily constructed and is yet more erosion resistant than known prior art frac heads.

SUMMARY OF THE INVENTION

It is therefore an object of the invention to provide a frac head that is more quickly and easily constructed and is yet more erosion resistant than known prior art frac head.

The invention therefore provides an erosion resistant frac head, comprising: a frac head body having a top end with an axial port and a central passage that extends through the axial port and the frac head body, an annular shoulder that surrounds the axial port and is downwardly inclined with respect to the axial port; at least two top entry ports in respective circular sockets machined in the annular shoulder, the circular sockets communicating with circular bores that communicate with the central passage; the central passage including a convergence chamber where the central passage and the circular bores converge, an expansion chamber with a downwardly and outwardly inclined sidewall directly below the convergence chamber, and a mixing chamber directly below the expansion chamber; and a replaceable bottom leg that terminates on a bottom end in a flange, the bottom leg being threadedly secured in a bottom leg socket in the frac head body.

The invention further provides an erosion resistant frac head, comprising: a frac head body having a top end with an axial port and a central passage that extends through the axial port and the frac head body, an annular shoulder that surrounds the axial port and is downwardly inclined with respect to the axial port; at least two top entry ports received in respective circular sockets machined in the annular shoulder, the at least two top entry ports being in fluid communication with circular bores that communicate with the central passage; the central passage including a convergence chamber where the central passage and the circular bores converge, an expansion chamber with a downwardly and outwardly inclined sidewall directly below the convergence chamber and a mixing chamber directly below the expansion chamber; and a bottom leg that terminates on a bottom end in a flange, the bottom leg being removably received in a bottom leg socket in the frac head body with an elongated pin thread that cooperates with a box thread of the bottom leg socket to secure the bottom leg in the bottom leg socket, and a lock nut threadedly secured to the elongated pin thread, the lock nut being tightened against a bottom end of the frac head body to lock the bottom leg in the bottom leg socket.

The invention yet further provides an erosion resistant frac head, comprising: a frac head body having a top end with an axial port and a central passage that extends though the axial port and the frac head body, an annular shoulder that surrounds the axial port and is downwardly inclined with respect to the axial port; at least two top entry ports received in respective circular sockets machined in the annular shoulder, the circular sockets communicating with circular bores that communicate with the central passage; a bottom leg that terminates on a bottom end in a flange, the bottom leg being removably secured in a bottom leg socket in the frac head body; and the central passage including a convergence chamber where the central passage and the circular bores converge, an expansion chamber with a downwardly and outwardly inclined sidewall directly below the convergence chamber and a mixing chamber directly below the expansion chamber.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides an erosion resistant frac head that is more quickly and easily constructed, so that costs associated with frac head construction and assembly are reduced. The erosion resistant frac head also channels abrasive fluids into a mixing chamber of the frac head in a way that reduces turbulence. The reduction of turbulence reduces erosion due to abrasion, so a service life of the frac head components is prolonged. In one embodiment the erosion resistant frac head has a replaceable bottom leg. The replaceable bottom leg permits the erosion resistant frac head to be refurbished in the field before it must be returned to a machine shop to be completely overhauled or recycled. In another embodiment the top entry ports of the erosion resistant frac head are also replaceable. This permits those components to be replaced with new or refurbished parts using only wrenches. No welding is required.

Figure 1:
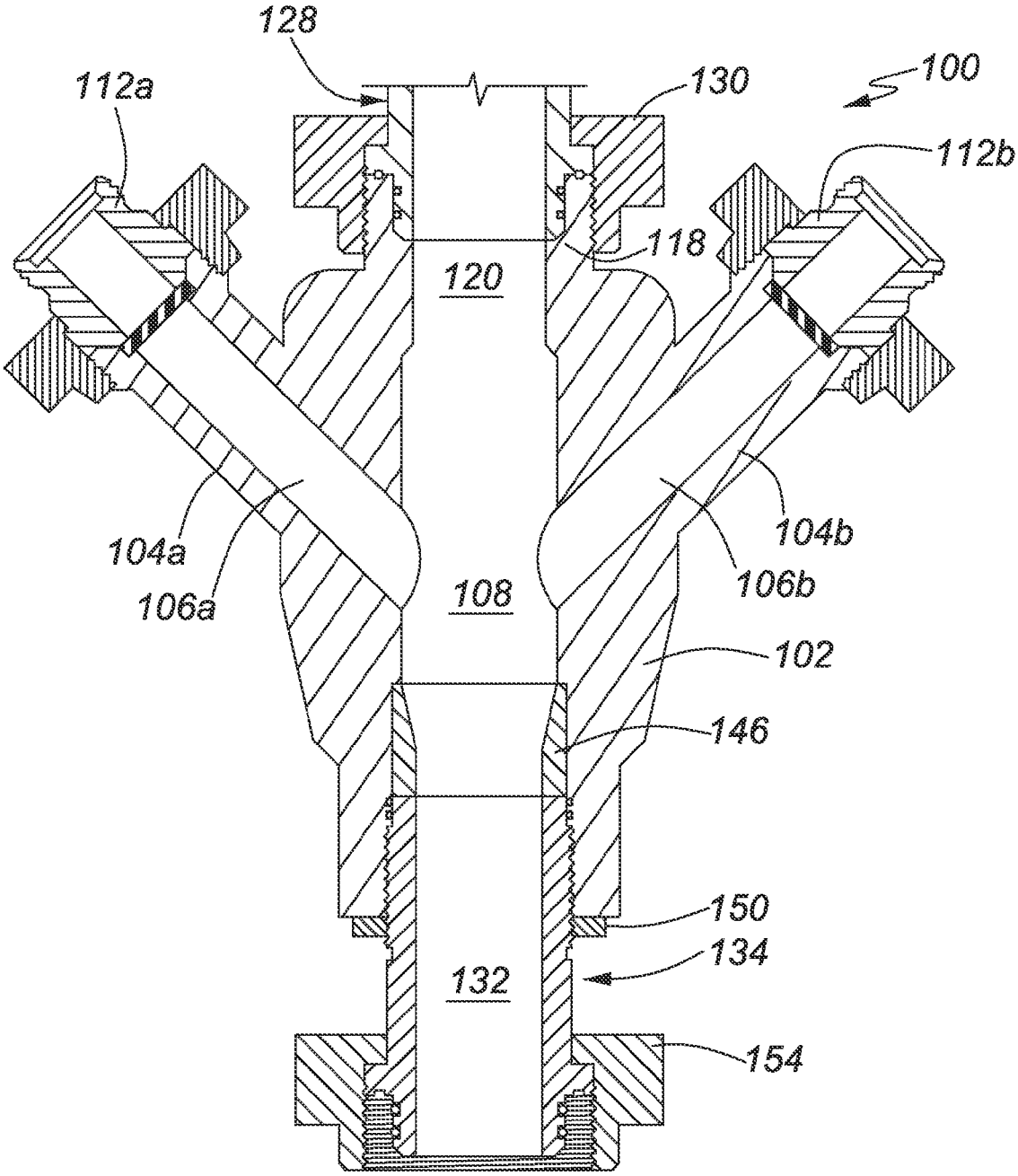
FIG. 1 (PRIOR ART)
FIG. 1 is a schematic cross-sectional diagram of one embodiment of Assignee's multipart frac head with replaceable components.
Figure 2:
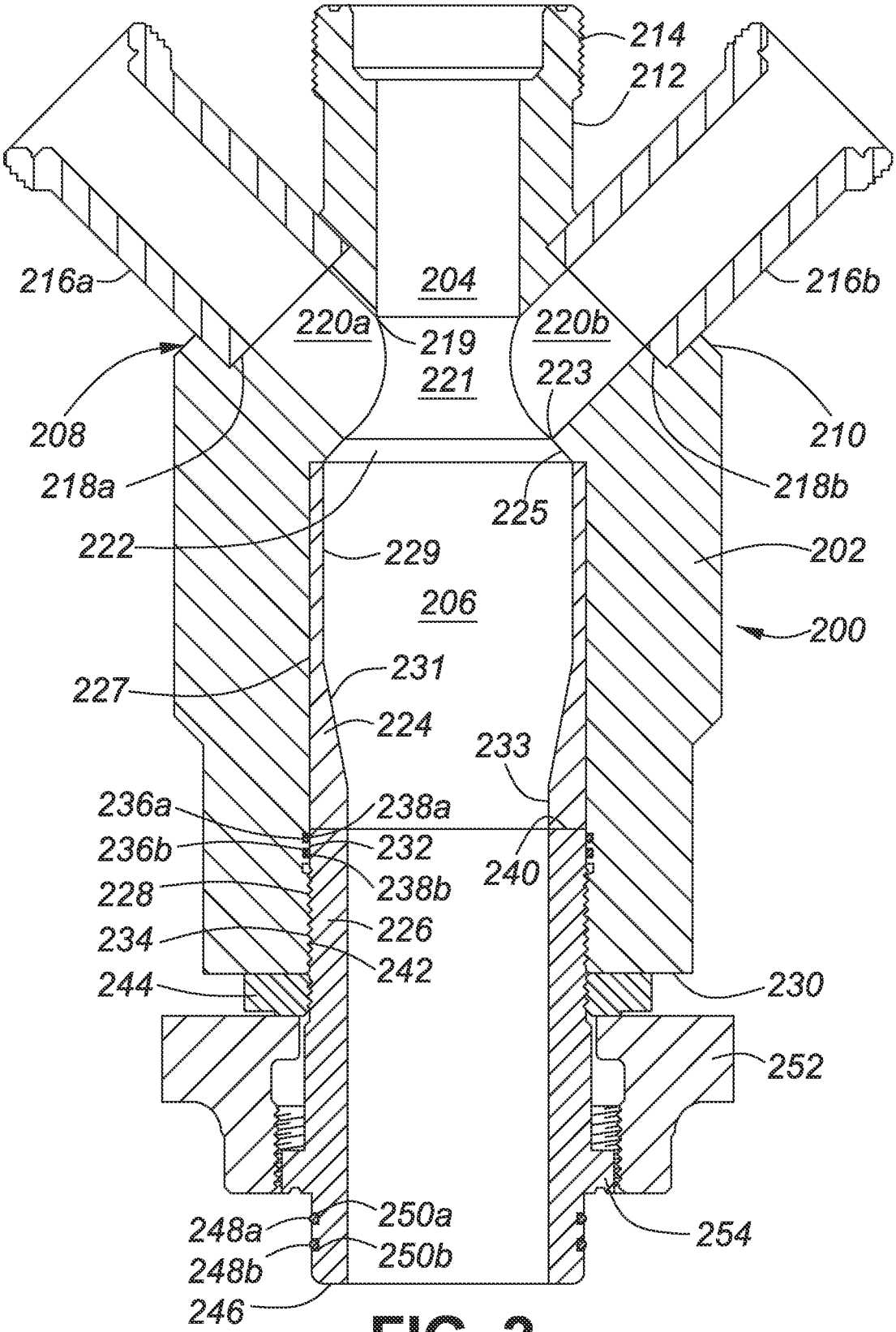
FIG. 2 is a schematic cross-sectional diagram of one embodiment of an erosion resistant frac head in accordance with the invention.

FIG. 2 is a schematic cross-sectional view of one embodiment of an erosion resistant frac 200 head in accordance with the invention. Parts for the erosion resistant frac head 200 are machined using a CNC (Computer Numeric Control) boring milling machine, which is known in the art. The erosion resistant frac head 200 includes a frac head body 202 with a top end 208 that includes an annular shoulder 210 that surrounds an axial port 212. The annular shoulder 210 is downwardly inclined with respect to the axial port 212. In this embodiment the annular shoulder 210 is downwardly inclined with respect to the axial port 212 at an angle of about 45° with respect to a central axis of the frac head body 202. A central passage 204 extends through the axial port 212 and the frac head body 202. The axial port 212 terminates in a threaded union 214 described in Assignee's above-referenced U.S. Pat. No. 7,125,055.

At least two top entry ports 216*a*, 216*b* are secured in circular sockets 218*a*, 218*b* machined in the annular shoulder 210. Circular bores 220*a*, 220*b* having a diameter equal to an internal diameter of the respective top entry ports 216*a*, 216*b* provide fluid communication between the respective top entry ports 216*a*, 216*b* and the central passage 204. After the top entry ports 216*a*, 216*b* are inserted into the respective circular sockets 218*a*, 218*b* they are welded in place using a linear weld bead laid around a periphery of the circular sockets 218*a*, 218*b*. This welding operation is quickly and easily performed after the parts are preheated, as described in Assignee's above-referenced co-pending patent application.

The central passage 204 enlarges downwardly from a top 219 of the circular bores 220*a*, 220*b* to provide a convergence chamber 221. The convergence chamber 221 is about 25% wider at a bottom 223 of the circular bores 220*a*, 220*b* than at the top 219. An expansion chamber 222 below the convergence chamber 221 has a downwardly and outwardly inclined sidewall 225 that permits converging frac fluid streams to rapidly expand as they exit the convergence chamber 221. In this embodiment, the sidewall 225 of the expansion chamber 222 is downwardly and outwardly inclined at an angle of about 45° with respect to the central axis of the frac head body 202. It should be understood that an angle of inclination of less than or considerably greater than 45° could be used for the sidewall 225 of the expansion chamber 222. The shape of the expansion chamber 222 permits the converging frac fluid streams to flow into the mixing chamber 206 with reduced turbulence. The mixing chamber 206 is lined with an abrasion resistant liner 224. The abrasion resistant liner has a cylindrical outer sidewall 227 and an inner sidewall that has a cylindrical upper section 229, a downwardly and inwardly inclined central section 231 and a cylindrical lower section 233. In this embodiment the abrasion resistant liner 224 is made of hardened 4140 steel, though any durable abrasion resistant material including a ceramic material may be used to line the mixing chamber 206.

The abrasion resistant liner 224 is supported by a bottom leg 226 threadedly secured in a bottom leg socket 228 machined into a bottom end 230 of the frac head body 202. The bottom leg socket 228 includes a seal bore 232 located inwardly of a box thread 234. The seal bore includes two O-ring grooves 236*a*, 236*b* that respectively accept O-rings 238*a*, 238*b*. A top end 240 of the bottom leg 226 is received in the seal bore 232 and cooperates with the O-rings 236*a*, 236*b* to provide a high-pressure fluid seal between the bottom leg 226 and the bottom leg socket 228. An elongated pin thread 242 on the bottom leg 226 engages the box thread 234 to secure the bottom leg 226 in the bottom leg socket 228. A lock nut 244 engages an outer end of the pin thread 242 and is tightened against the bottom end 230 of the frac head body 202 to inhibit rotation of the bottom leg 226 with respect to the frac head body 202. The bottom leg 226 terminates in a threaded union connector of the type described in Assignee's above-referenced U.S. Pat. No. 7,125,055. The threaded union connector includes a pin end 246 with two O-rings 248*a*, 248*b* received in O-ring grooves 250*a*, 250*b*. A wing nut 252 is supported by an annular shoulder 254 on a lower periphery of the bottom leg 226.

As will be understood by those skilled in the art, the abrasion resistant liner 224 and/or the bottom leg 226 can be replaced by field hands using new or refurbished replacement parts. Consequently, the erosion resistant frac head 200 is less expensive to maintain. The erosion resistant frac head 200 is also less expensive to build because its constructed using machined parts that require only linear welding to secure the top entry ports 216*a*, 216*b* in the circular sockets 218*a*, 218*b*. Furthermore, field tests have established that the erosion resistant frac head 200 is quite resistant to "wash". Even when unbalanced input streams of frac fluid are pumped through the frac head 200, very little wash occurs. This is unexpected because input streams that are unbalanced in pressure, volume and/or velocity are known to cause wash in frac heads.

Figure 3:
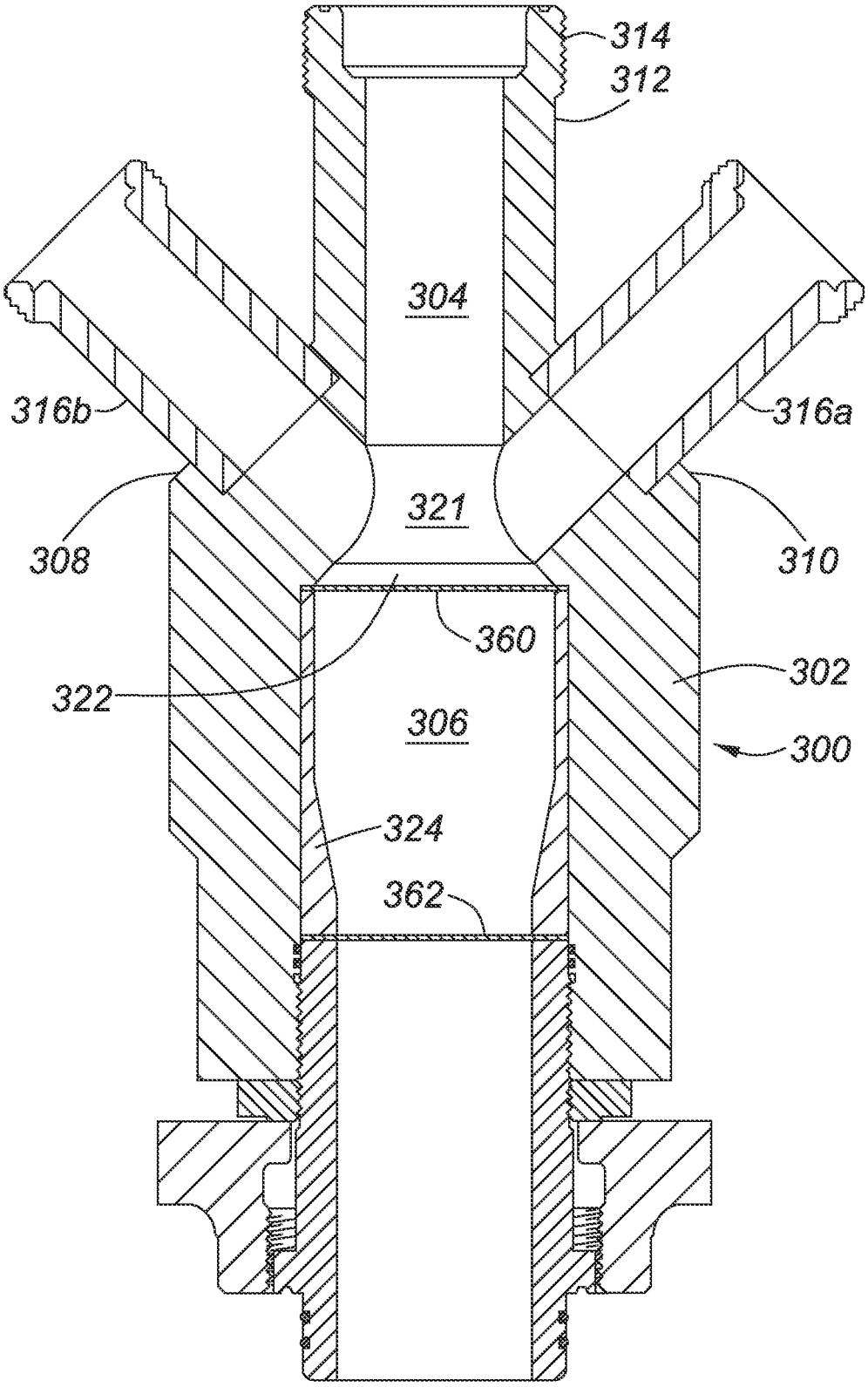
FIG. 3 is a schematic cross-sectional diagram of yet another embodiment of the erosion resistant frac head in accordance with the invention.

FIG. 3 is a schematic cross-sectional view of an erosion resistant frac head 300 in accordance with the invention. The erosion resistant frac head 300 closely resembles the erosion resistant frac head 200 described above with reference to FIG. 2. The erosion resistant frac head body 302 has a longer axial port 312, which provides better access to threaded union 314. Top end 308 with annular shoulder 310 supports at least two top entry ports 316*a* and 316*b*. The top entry ports are the same as those described above with reference to FIG. 2. A mixing chamber 306 is lined by an abrasion resistant liner 324 similar to the one described above with reference to FIG. 2, except that pancake gaskets 360 and 362 respectively inhibit frac fluid and propant from migrating from the mixing chamber 306 around the abrasion resistant liner 324. A convergence chamber 321 and expansion chamber 322 are identical to those described above, as are other components of the frac head 300, which will not be redundantly described. It should be noted that the pancake gaskets 360, 362 could also be used to seal around the abrasion resistant liner 224 shown in FIG. 2.

Figure 4:
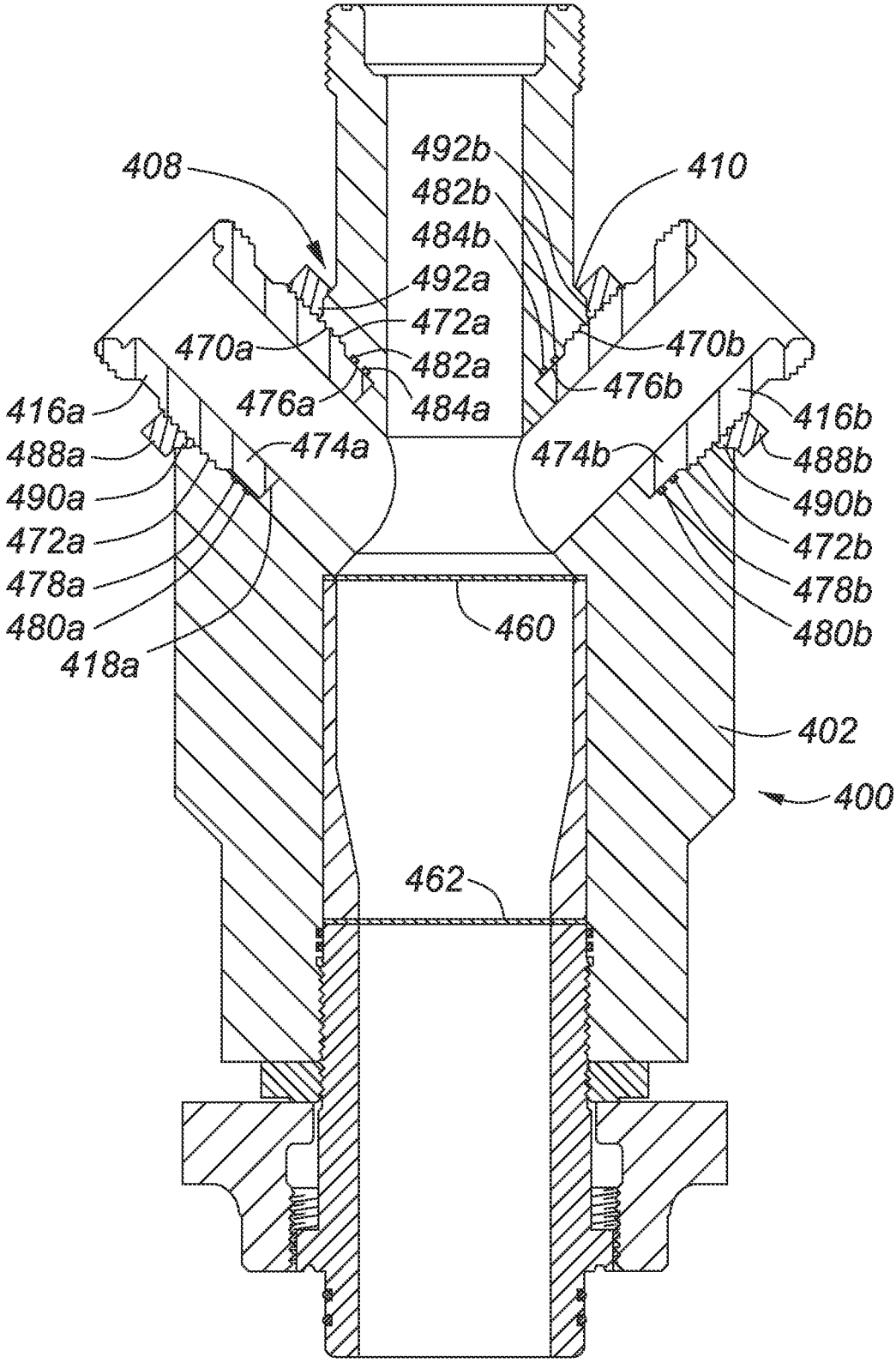
FIG. 4 is a schematic cross-sectional diagram of a further embodiment of the erosion resistant frac head in accordance with the invention.

FIG. 4 is a cross-sectional schematic diagram an erosion resistant frac head 400 in accordance with the invention. Erosion resistant frac head 400 is similar to the erosion resistant frac head 300 described above, except that top entry ports 416*a*, 416*b* are threadedly secured in box threaded circular sockets 418*a* and 418*b* machined in an annular shoulder 410 at a top end 408 of a frac head body 402.

A pin thread 470*a*, 470*b* on an external periphery of an inner end of the respective top entry ports 416*a*, 416*b* engages a box thread 472*a*, 472*b* in the respective box threaded circular sockets 418*a* and 418*b*. A cylindrical terminal end 474*a*, 474*b* of the respective top entry ports 416*a*, 416*b* is received in respective seal bores 476*a*, 476*b* at a bottom of the respective circular sockets 418*a*, 418*b*. High pressure O-rings 478*a,b* and 480*a,b* respectively received in O-ring grooves 482*a,b* and 484*a,b* in the respective circular sockets 418*a*, 418*b* provide a high-pressure seal around each top entry port 416*a*, 416*b*. Although the O-rings 478*a,b* and 480*a,b* are shown in the O-ring grooves 482*a,b* and 484*a,b* in the respective seal bores 476*a*, 476*b*, it should understood that the seal bores 476*a*, 476*b* could be smooth bores and the O-rings could be received in O-ring grooves on the terminal ends 474*a*, 474*b* of the top entry ports 416*a*, 416*b*.

Lock nuts 488*a*, 488*b* inhibit rotation of the respective top entry ports 416*a*, 416*b*. The lock nuts 488*a* and 488*b* respectively include an annular boss 490*a*, 490*b* on their bottom surface. The annular boss 490*a*, 490*b* has an outer edge that is downwardly and inwardly inclined. In this embodiment the outer edge of the annular boss 490*a*, 490*b* is inclined at an angle of about 45°, although any angle from 30° to 90° can be used. The annular boss 490*a*, 490*b* is received in a respective complementary socket 492*a*, 492*b* when the respective lock nuts 488*a*, 488*b* are tightened against the annular shoulder 410. The annular boss 490*a*, 490*b* reinforces the respective top entry ports 416*a*, 416*b* against vibration and other applied forces when frac irons (not shown) are connected to the top entry ports 416*a*, 416*b* and frac fluid is pumped through the frac head 400.

Figure 5:
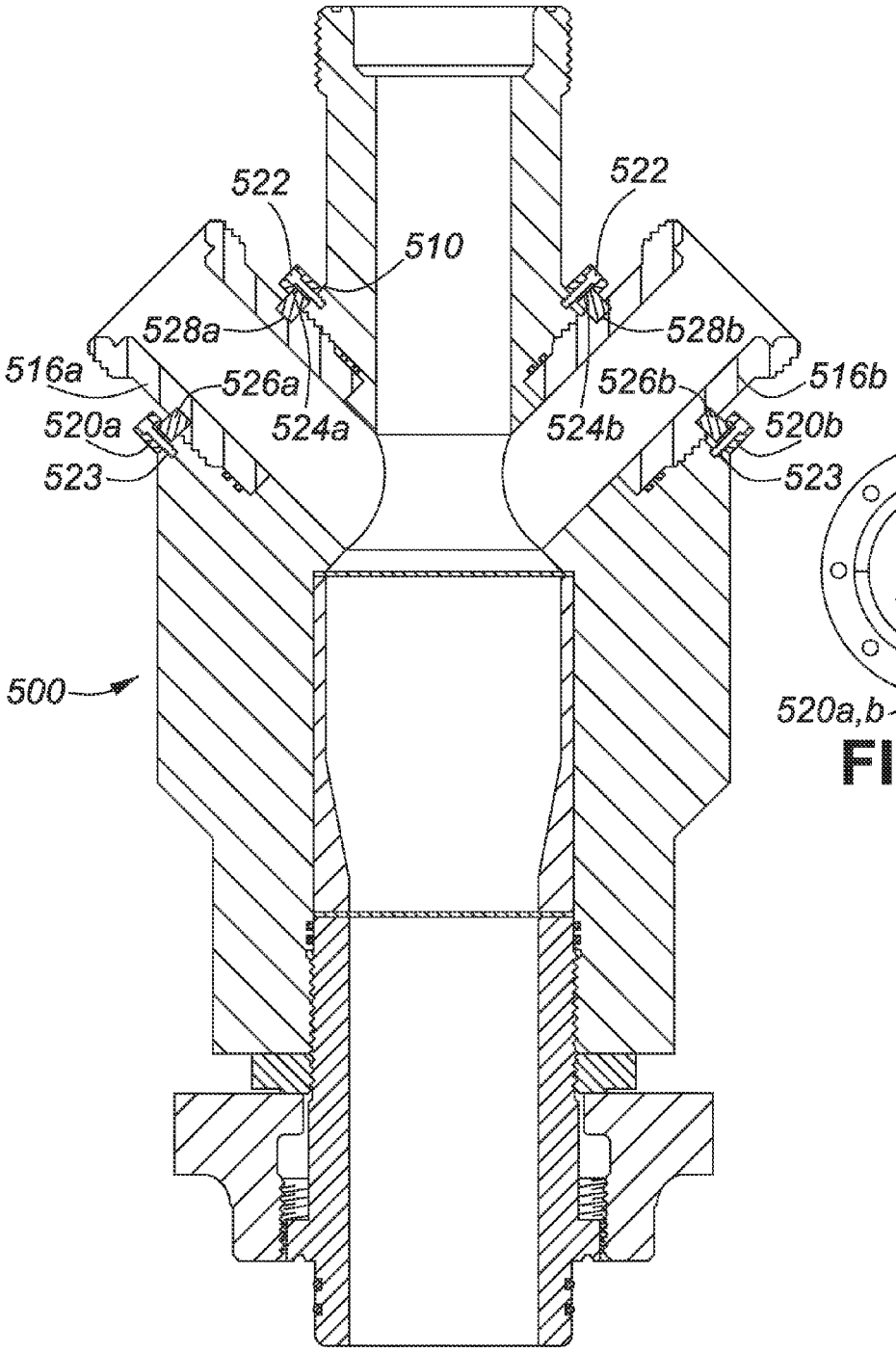
FIG. 5 is a schematic cross-sectional diagram of yet another embodiment of the erosion resistant frac head in accordance with the invention.
Figure 5A:
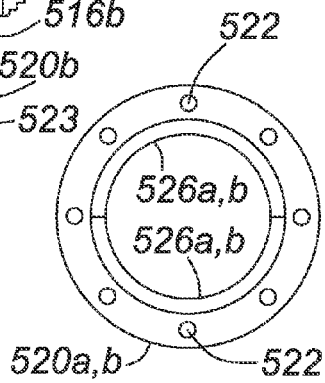
FIG. 5*a* is a schematic plan view of a flange used to secure top entry ports of the erosion resistant frac head shown in FIG. 5.

FIG. 5 is a cross-sectional schematic diagram of yet another embodiment of the erosion resistant frac head in accordance with the invention. Erosion resistant frac head 500 is identical to the erosion resistant frac head 400 described above, except that top entry ports 516*a*, 516*b* are reinforced against vibration and other applied forces by circular flanges 520*a*, 520*b* (see also FIG. 5*a*). The circular flanges 520*a*, 520*b* are connected to the annular shoulder 510 by a plurality of bolts 522 that are received in threaded bores 523 in the annular shoulder 510. A cut away inner bottom corner 524*a*, 524*b* of the flanges 520*a*, 520*b* receives an outer side of circular segments 526*a*, 526*b*. The circular segments 526*a*, 526*b* are respectively received in annular grooves 528*a*, 528*b* in an outer sidewall of the respective top entry ports 516*a*, 516*b*.

The top entry ports 516*a*, 516*b* are installed in the frac head 500 by placing the respective flanges 520*a*, 520*b* over respective bottom ends of the top entry ports 516*a*, 516*b* before they are screwed into their respective box threaded circular sockets. Before the respective top entry ports 516*a* and 516*b* are tightened down in their box threaded circular sockets, the circular segments 526*a*, 526*b* are inserted into the respective annular grooves 528*a* and 528*b*. The respective top entry ports 516*a*, 516*b* are then tightened down and the respective flanges 520*a* and 520*b* are aligned with the threaded bores 523. The bolts 522 are then treaded into the threaded bores 523 to fasten the respective flanges 520*a*, 520*b* securely in place. As explained above, the circular segments 526*a*, 526*b* and the secured flanges 520*a*, 520*b* reinforce the respective top entry ports 516*a*, 516*b* against vibration and other applied forces when frac irons (not shown) are connected to the top entry ports 516*a*, 516*b* and frac fluid is pumped through the frac head 500. It should be understood that the circular segments 526*a,b* described above could be replaced by an integral annular shoulder on an outer periphery of the respective top entry ports 516*a*, 516*b*.

Figure 6:
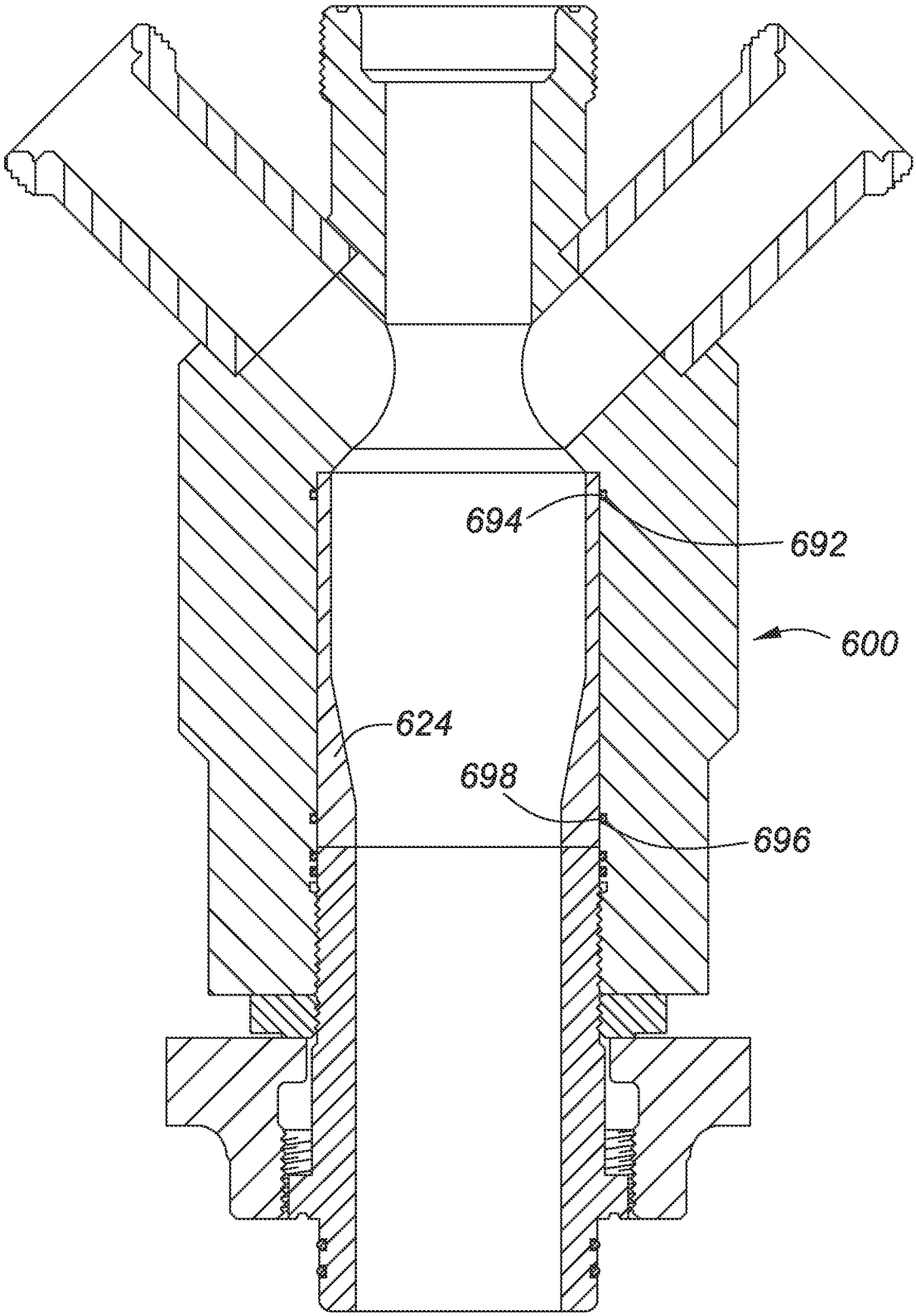
FIG. 6 is a schematic cross-sectional diagram of yet another embodiment of the erosion resistant frac head in accordance with the invention.

FIG. 6 is a schematic cross-sectional view of frac head 600 in accordance with the invention, which illustrates an alternate method of sealing a space between the frac head body 602 and the abrasion resistant liner 624. In this embodiment, an O-ring groove 692 in the frac head body 602 near a top end of the abrasion resistant liner 624 accepts a high-pressure O-ring 694 that cooperates with an outer wall of the abrasion resistant liner 624 to inhibit a migration of frac fluids into a space between the abrasion resistant liner 624 and the frac head body 602. Likewise, an O-ring groove 696 in the frac head body 602 near a bottom end of the abrasion resistant liner 624 accepts a high-pressure O-ring 698 that cooperates with an outer wall of the abrasion resistant liner 624 to inhibit a migration of frac fluids into a space between the abrasion resistant liner 624 and the frac head body 602.

It should be understood that the O-rings 694, 698 received in the O-ring grooves 692, 696 shown in FIG. 6 could also be used to seal the space between the abrasion resistant liner and the frac head body of any one of the embodiments of the invention described above with reference to FIGS. 2-5. When the O-rings 694, 698 are used, the pancake gaskets described above are unnecessary, and when the pancake gaskets are used the O-rings are unnecessary.

Figure 7:
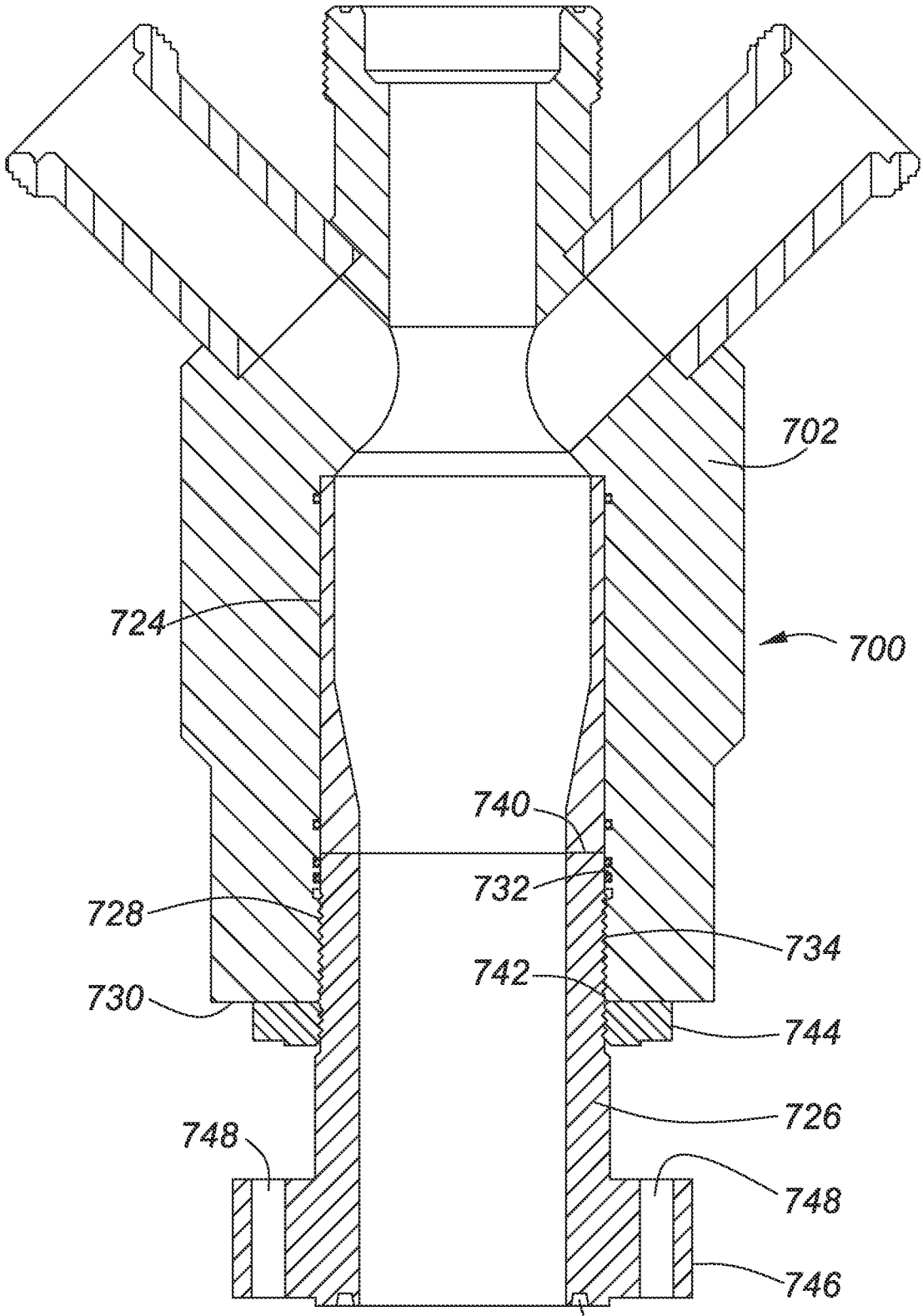
FIG. 7 is a schematic cross-sectional diagram of yet a further embodiment of the erosion resistant frac head in accordance with the invention.

FIG. 7 is a schematic cross-sectional view of frac head 700 in accordance with a further embodiment of the invention. In this embodiment an abrasion resistant liner 724 is supported by a bottom leg 726 threadedly secured in the bottom leg socket 728 machined into the bottom end 730 of the frac head body 702. The bottom leg socket 728 includes the seal bore 732 located inwardly of the box thread 734. A top end 740 of the bottom leg 726 is received in the seal bore 732. An elongated pin thread 742 on the bottom leg 726 engages the box thread 734 to secure the bottom leg 726 in the bottom leg socket 728. A lock nut 744 engages an outer end of the pin thread 742 and is tightened against the bottom end 730 of the frac head body 702 to inhibit rotation of the bottom leg 726 with respect to the frac head body 702. The bottom leg 726 terminates in flange 746 having a plurality of through bores 748 that accept flange bolts for connecting the frac head 700 to a wellhead, a blowout preventer, or the like. The flange 746 further includes a ring gasket groove 750 that accepts a metal ring gasket. In one embodiment the flange 746 is an American Petroleum Institute (API) flange and the metal ring gasket groove 750 accepts one of an API R, RX or BX ring gasket.

It should be understood that the bottom leg 726 can be used in conjunction with any of the embodiments of the invention described above with reference to FIGS. 1-6.

While various embodiments of the frac heads in accordance with the invention have been described, it should be understood that the embodiments described above are exemplary only. For example, the frac heads 200, 300, 400, 500 or 600 may be constructed with an integral bottom leg as taught in Assignee's U.S. Pat. No. 7,213,641 which issued on May 8, 2007, the specification of which is incorporated herein by reference in its entirety. Other changes within the skill of an ordinary person in the art may also become apparent.

The scope of the invention is therefore intended to be limited solely by the scope of the appended claims.

I claim:

1. An erosion resistant frac head, comprising:

a frac head body having a top end with an axial port and a central passage that extends though the axial port and the frac head body, an annular shoulder that surrounds the axial port and is downwardly inclined with respect to the axial port;

at least two top entry ports in respective circular sockets machined in the annular shoulder, the circular sockets communicating with circular bores that communicate with the central passage;

the central passage including a convergence chamber where the central passage and the circular bores converge, a bottom of the convergence chamber being wider than a top of the convergence chamber; an expansion chamber with a downwardly and outwardly inclined sidewall directly below the convergence chamber; and, a mixing chamber directly below the expansion chamber; and a replaceable bottom leg having a bottom end that comprises a flange, the bottom leg being threadedly secured in a bottom leg socket in the frac head body.

2. The erosion resistant frac head as claimed in claim 1 wherein the replaceable bottom leg comprises an elongated pin thread that cooperates with a box thread of the bottom leg socket to secure the replaceable bottom leg in the bottom leg socket, and a lock nut threadedly secured to the elongated pin thread, the lock nut being adapted to be tightened against a bottom end of the frac head body to lock the replaceable bottom leg in the bottom leg socket.

3. The erosion resistant frac head as claimed in claim 2 wherein the replaceable bottom leg retains an abrasion resistant liner that forms the mixing chamber of the frac head body.

4. The erosion resistant frac head as claimed in claim 3 further comprising an O-ring received in an O-ring groove in the frac head body adjacent both a top end and a bottom end of an outer sidewall of the abrasion resistant liner.

5. The erosion resistant frac head as claimed in claim 1 wherein the axial port terminates in a threaded union.

6. The erosion resistant frac head as claimed in claim 1 wherein the outwardly and downwardly inclined sidewall of the expansion chamber is downwardly inclined at about 45° with respect to a central axis of the frac head body.

7. The erosion resistant frac head as claimed in claim 1 wherein the convergence chamber is about 25% wider at the bottom of the convergence chamber than at the top of the convergence chamber.

8. The erosion resistant frac head as claimed in claim 1 further comprising an abrasion resistant liner that lines the mixing chamber and is supported by a top end of the replaceable bottom leg.

9. The erosion resistant frac head as claimed in claim 8 wherein the abrasion resistant liner has a cylindrical outer sidewall, and an inner sidewall that has a cylindrical upper section, a downwardly and inwardly inclined central section, and a cylindrical lower section.

10. An erosion resistant frac head, comprising:

a frac head body having a top end with an axial port and a central passage that extends though the axial port and the frac head body, an annular shoulder that surrounds the axial port and is downwardly inclined with respect to the axial port;

at least two top entry ports received in respective circular sockets machined in the annular shoulder, the at least two top entry ports being in fluid communication with circular bores that communicate with the central passage;

the central passage including a convergence chamber where the central passage and the circular bores converge, a bottom of the convergence chamber being wider than a top of the convergence chamber; an expansion chamber with a downwardly and outwardly inclined sidewall directly below the convergence chamber; and, a mixing chamber directly below the expansion chamber; and a bottom leg having a bottom end that comprises a flange, the bottom leg being removably received in a bottom leg socket in the frac head body with an elongated pin thread that cooperates with a box thread of the bottom leg socket to secure the bottom leg in the bottom leg socket, and a lock nut threadedly secured to the elongated pin thread, the lock nut being tightened against a bottom end of the frac head body to lock the bottom leg in the bottom leg socket.

11. The erosion resistant frac head as claimed in claim 10 wherein the outwardly and downwardly inclined sidewall of the expansion chamber is inclined at an angle of at least 45° with respect to a central axis of the frac head body.

12. The erosion resistant frac head as claimed in claim 10 wherein the annular shoulder is downwardly inclined with respect to the axial port at an angle of about 45° with respect to a central axis of the frac head body.

13. The erosion resistant frac head as claimed in claim 10 wherein the convergence chamber is about 25% wider at the bottom of the convergence chamber than at the top of the convergence chamber.

14. The erosion resistant frac head as claimed in claim 10 further comprising an abrasion resistant liner that lines the mixing chamber and is supported by a top end of the bottom leg.

15. The erosion resistant frac head as claimed in claim 14 wherein the abrasion resistant liner has a cylindrical outer sidewall, and an inner sidewall that has a cylindrical upper section, a downwardly and inwardly inclined central section, and a cylindrical lower section.

16. An erosion resistant frac head, comprising:

a frac head body having a top end with an axial port and a central passage that extends though the axial port and the frac head body, an annular shoulder that surrounds the axial port and is downwardly inclined with respect to the axial port;

at least two top entry ports received in respective circular sockets machined in the annular shoulder, the circular sockets communicating with circular bores that communicate with the central passage;

a bottom leg having a bottom end comprising a flange, the bottom leg being removably secured in a bottom leg socket in the frac head body; and the central passage including a convergence chamber where the central passage and the circular bores converge, a bottom of the convergence chamber being wider than a top of the convergence chamber; an expansion chamber with a downwardly and outwardly inclined sidewall directly below the convergence chamber; and, a mixing chamber directly below the expansion chamber.

17. The erosion resistant frac head as claimed in claim 16 further comprising an abrasion resistant liner in the mixing chamber that is supported by a top end of the bottom leg.

18. The erosion resistant frac head as claimed in claim 17 further comprising fluid seals to inhibit fluid penetration between the mixing chamber and the abrasion resistant liner.

19. The erosion resistant frac head as claimed in claim 16 wherein the convergence chamber is about 25% wider at the bottom of the convergence chamber than at the top of the convergence chamber.

* * * * *